US009149841B2

(12) United States Patent
Ghosh

(10) Patent No.: US 9,149,841 B2
(45) Date of Patent: Oct. 6, 2015

(54) SCREEN PANEL

(75) Inventor: Arobindo Ghosh, Kolkata (IN)

(73) Assignee: TEGA Industries Limited, Kolkata (IN)

( * ) Notice: Subject to any disclaimer, the term of this patent is extended or adjusted under 35 U.S.C. 154(b) by 0 days.

(21) Appl. No.: 13/699,148

(22) PCT Filed: Mar. 11, 2011

(86) PCT No.: PCT/IN2011/000168

§ 371 (c)(1),
(2), (4) Date: Feb. 5, 2013

(87) PCT Pub. No.: WO2011/145103

PCT Pub. Date: Nov. 24, 2011

(65) Prior Publication Data

US 2013/0126397 A1 May 23, 2013

(30) Foreign Application Priority Data

May 21, 2010 (IN) ..... 558/KOL/2010

(51) Int. Cl.
*B07B 1/49* (2006.01)
*B07B 1/46* (2006.01)

(52) U.S. Cl.
CPC ..... *B07B 1/4645* (2013.01); *B07B 1/46* (2013.01); *B07B 1/4618* (2013.01); *B07B 1/4627* (2013.01); *B07B 2201/02* (2013.01); *Y10T 29/49826* (2015.01)

(58) Field of Classification Search
CPC ..... B07B 1/46; B07B 1/4645; B07B 1/469; B07B 2201/02
USPC ..... 209/395, 399, 403, 405, 412
See application file for complete search history.

(56) References Cited

U.S. PATENT DOCUMENTS 6,736,271 B1 * 5/2004 Hall ..... 209/409
6,955,022 B2 10/2005 Imam
8,047,380 B2 * 11/2011 Van Rensburg ..... 209/397
8,231,010 B2 * 7/2012 Scott et al. ..... 209/397

(Continued)

FOREIGN PATENT DOCUMENTS

DE 8712708 U1 11/1987
EP 0291675 B1 5/1992

(Continued)

OTHER PUBLICATIONS

PCT International Search Report and Written Opinion dated Oct. 20, 2011 issued on corresponding PCT application No. PCT/IN2011/000168 filed Mar. 11, 2011.

*Primary Examiner* — Joseph C Rodriguez
*Assistant Examiner* — Kalyanavenkateshware Kumar
(74) *Attorney, Agent, or Firm* — Locke Lord LLP; Joshua L. Jones; Christopher J. Cillié

(57) ABSTRACT

A screen panel for mining and quarrying industries adapted to be mounted on a screen deck including a wear section (2) and a reinforcement section (1), said wear section (2) comprising a screening surface made up of materials such as herein described formed on said reinforcement section (1) such as herein described, said wear section being the top portion of said panel and said reinforcement section being the bottom portion of said panel, said wear section and said reinforcement section being separate units and said wear section being adapted (4) to be replaceable from time to time, for ensuring smooth functioning of screening operation.

17 Claims, 9 Drawing Sheets

(56) References Cited

U.S. PATENT DOCUMENTS

| | | | | |
|---|---|---|---|---|
| 2003/0136710 | A1 | 7/2003 | Adams et al. | |
| 2009/0301945 | A1* | 12/2009 | Trench et al. | 209/405 |
| 2012/0199521 | A1* | 8/2012 | Mohanka | 209/392 |

FOREIGN PATENT DOCUMENTS

| | | | |
|---|---|---|---|
| IN | 231453 | | 12/2005 |
| WO | WO-92/00133 | A1 | 1/1992 |
| WO | WO-00/53343 | A1 | 9/2000 |

* cited by examiner

SCREEN PANEL

CROSS-REFERENCE TO RELATED APPLICATIONS

This application is a U.S. national stage application under 35 U.S.C. 371 of International Application No. PCT/IN2011/000168 filed on Mar. 11, 2011, which claims priority to Indian Patent Application No. 558/KOL/2010 filed on May 21, 2010, each of which is incorporated by reference herein in its entirety.

FIELD OF THE INVENTION

The present invention in general relates to screening panel for screening/separating or grading of minerals in the mining and quarrying industries and in particular to screen panels equipped with replaceable wearing/functional sections.

BACKGROUND OF THE INVENTION

Screening panel system for ore screening decks that is now widely used by the mining industry, replaced the earlier screening cloths and large wire screening frames. These screening panels are known to be either of Rubber or Polyurethane with steel reinforcements. It is also known that such panels are manufactured by hot vulcanized method or casting. The panels are adapted to be secured with the support frame of the screen machine by bolting. The panels may also be secured to the frame with an alternate method using a pin and separate lug arrangement.

A difficulty encountered in using these panels is that the whole panel needs to be replaced with a minimum defect in the aperture zone due to cutting of aperture or wearing of aperture where screening area thickness is reduced. This affects the strength of apertured area of the panel and also the cut point. In a screen panel the edges are thicker than the screening portion as in the edges, the internal reinforcements are placed which needs to be wear protected. However, the main wear portion is the screening area thickness i.e in the aperture zone which is the functional zone. Conventionally the functional zone and the reinforcement zone are homogeneous and one piece. Hence, at the time of replacement of panels the customer has to change the entire panel i.e the functional zone or wear zone and the reinforcement zone being one, homogeneous and integral. Further, the integral nature of the screen panels add on to the overall weight triggering, handling inconveniences.

Accordingly there was a long felt need to design improved screen panels for its application in mining and quarrying industries, which have replaceable wearing/functional sections and which are light weight, easy to handle and have substantially low manufacturing cost.

The present invention meets the aforesaid long felt need.

All through out the specification including the claims, the words "screen panel", "mining", "quarrying", "mineral", "ores", "abrasion resistant", "wear resistant", "sections", "zones", "wear zone/section", "reinforcement zone/section" are to be interpreted in the broadest sense of the respective terms and includes all similar items in the field known by other terms, as may be clear to persons skilled in the art. Restriction/limitation, if any, referred to in the specification, is solely by way of example and understanding the present invention.

OBJECTS OF THE INVENTION

It is the principal object of the present invention to provide a screen panel with replaceable wearing/functional sections for its application in mining and quarrying industries.

It is a further object of the present invention to provide a screen panel with replaceable wearing/functional sections having higher longevity and which is flexible.

It is a further object of the present invention to provide a screen panel with replaceable wearing/functional sections having light weight and consequently, is easy to handle.

It is yet another object of the present invention to provide a screen panel with replaceable wearing/functional sections which have a substantially low cost of manufacturing.

It is a further object of the present invention to provide a screen panel with replaceable wearing/functional sections which ensures easy fitting of the panels and substantially reduces the spares cost.

It is another object of the present invention to provide a screen panel with replaceable wearing/functional sections which ensures prevention of clogging of materials during screening.

It is another object of the present invention to provide a method for manufacturing a screen panel with replaceable wearing/functional sections for its application in mining and quarrying industries.

How the foregoing objects are achieved and the other aspects of the present invention, will be clear from the following description which is purely by way of understanding and not by way of any sort of limitation.

SUMMARY OF THE INVENTION

Accordingly, the present invention provides a screen panel for mining and quarrying industries adapted to be mounted on a screen deck including a wear section and a reinforcement section, said wear section comprising a screening surface made up of materials such as herein described formed on said reinforcement section such as herein described, said wear section being the top portion of said panel and said reinforcement section being the bottom portion of said panel, said wear section and said reinforcement section being separate units and said wear section being adapted to be replaceable from time to time, for ensuring smooth functioning of screening operation.

In accordance with preferred embodiments of the screen panel of the present invention:

- said screening area comprises abrasion resistant apertures having a flaring design;
- said wear section is separated into two or more units;
- said wear section and said reinforcing section are adapted to be attached to each other by button type snug fitting or by pin and lug arrangement or by bolting;
- said wear section is made up of polyurethane/rubber/steel and said reinforcement section is a frame made by hot vulcanizing or casting with rubber or polyurethane;
- said screening surface is made of any one of or a combination of mild steel, stainless steel, rubber and/or polyurethane with or without steel reinforcing;
- said panel comprises of vulcanized material, rubber polyurethane, having embedded within it steel reinforcing bars, at the outer edges of said panel and extended across the inner area of said panel, thereby providing support to said screening surface;
- the reinforcement section of said panel is fitted to the machine frame by button type snug fitting or by pin and lug arrangement or by bolting.

The present invention also provides a method of manufacturing a screen panel for mining and quarrying industries adapted to be mounted on a screen deck, including designing a wear section having a screening surface made up of materials such as herein described and a reinforcement section such as herein described and forming the wear section on said reinforcing section, said method further including making the said wear zone and said reinforcement zone as separate units such that, said wear section is replaceable from time to time, for ensuring smooth functioning of screening operation.

The present invention also provides a screening deck for mining and quarrying industries, having mounted thereon a plurality of screen panels, each said panel including a wear section and a reinforcement section, said wear section comprising a screening surface made up of materials such as herein described formed on said reinforcement section such as herein described, said wear section being the top portion of said panel and said reinforcement section being the bottom portion of said panel, said wear section and said reinforcement section being separate units and said wear section being adapted to be replaceable from time to time, for ensuring smooth functioning of screening operation.

BRIEF DESCRIPTION OF THE ACCOMPANYING DRAWINGS

The nature and scope of the present invention, will be better understood from the accompanying drawings, which are by way of illustration of some preferred embodiments and not by way of any sort of limitation. In the accompanying drawings, FIG. 1 illustrates a plan view of the screening surface in accordance with a preferred embodiment of the present invention.

FIG. 4(*b*) illustrates a sectional view of the screening surface in FIG. 4(*a*) along the line A-A.

FIG. 6(*b*) illustrates an enlarged sectional view of the panel in FIG. 6(*a*) along the line A-A.

FIG. 7(*b*) illustrates an enlarged sectional view of the screen panel in FIG. 7(*a*) along the line B-B.

FIG. 7 (*c*) illustrates an enlarged sectional view of the screen panel in FIG. 7(*a*) along the line A-A.

FIG. 8(*b*) illustrates an enlarged sectional view of the screen panel in FIG. 8(*a*) along the line A-A.

DETAILED DESCRIPTION OF THE INVENTION

The following describes some preferred embodiments of the present invention, which are purely for the sake of understanding the performance of the invention, and not by way of any sort of limitation.

It is traditionally known that screen panels basically comprise a wear/functional section and a reinforcement section. These sections are also commonly referred to as wear zones and reinforcement zones in the art of screening in mining and quarrying industries. The wear zones include screening surface/area with abrasion resistant apertures. The reinforcement zone comprises the reinforcement frame, which is eventually mounted on the machine frame. Traditionally, the functional zones and reinforcement zones are homogeneous and integral with one another or in other words, are made in one piece. Thus, after some time when the apertures get weared due to abrasion, the whole screen panel has to be changed, which renders the entire operation costly and inconvenient.

The present invention aims at the innovative step of separating the functional zone from the reinforcement zone, thus allowing the non wearing reinforcement zone to remain as it is and reusable, whereas the functional zone is changed from the top whenever it wears off. So, the customer replaces only the top portion of the panel and hence obviously the total cost reduces and the whole screening operation becomes very convenient. Also, this reduces the overall weight of the panels. Thus, the present invention provides screen panels with replaceable functional zones, for its application in mining and quarrying industries.

Ideally, the screening surface is made of any one of or a combination of mild steel, stainless steel, rubber and/or polyurethane with or without steel reinforcing.

The comprehensive panel preferably comprises of vulcanized material, rubber polyurethane, having embedded within it steel reinforcing bars, at the outer edges of said panel and extended across the inner area of said panel, thereby providing support to said screening surface.

Figure 1:
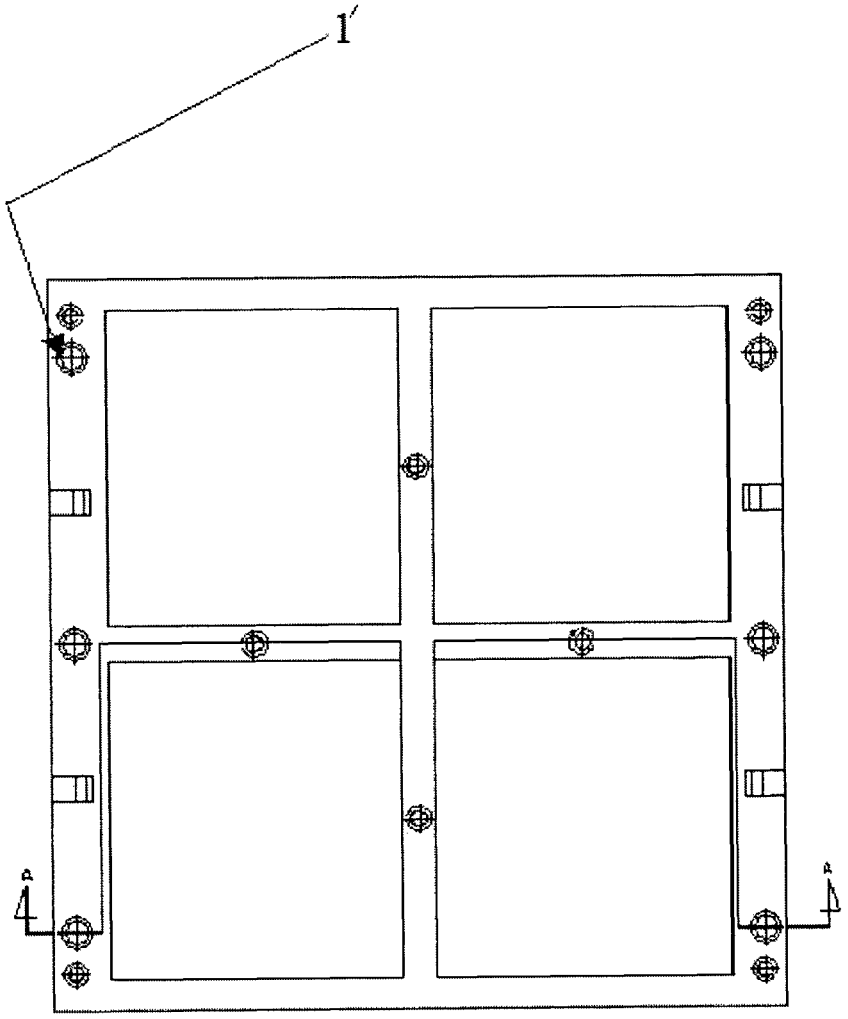

The accompanying FIG. 1 illustrates a plan view of the screening surface according to a preferred embodiment of the present invention. It shows the panel fixing frame 1', that is bolted/welded to the frame under the screen deck.

Figure 2:
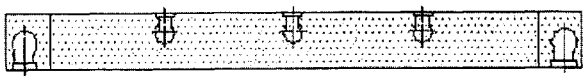
FIG. 2 illustrates a sectional view of the screening surface in FIG. 1 along the line A-A.

The accompanying FIG. 2 illustrates a side view of the screening surface illustrated in the FIG. 1.

The screening panels according to the present invention may be either of rubber or polyurethane with steel reinforcements. The bottom part or frame of the panel is manufactured by hot vulcanizing or casting with rubber or polyurethane.

Figure 3:
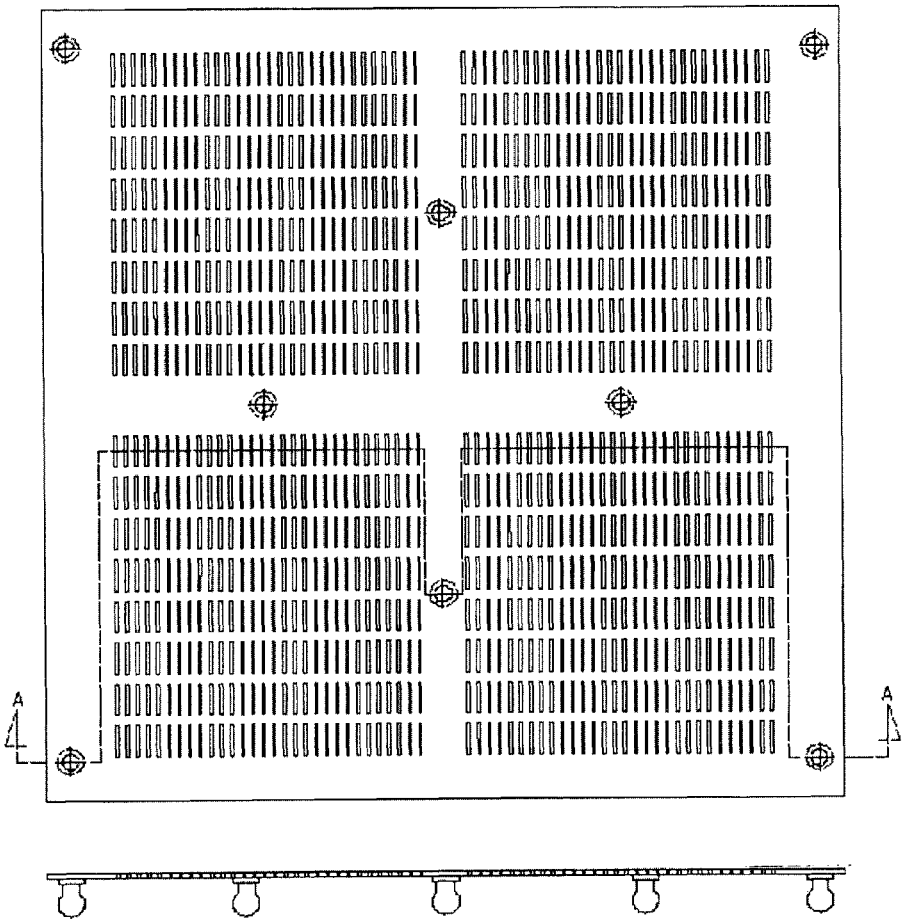
FIG. 3 illustrates an enlarged plan view of a preferred embodiment of the screening surface in accordance with the present invention and a sectional view of the same along the line A-A.

The accompanying FIG. 3 illustrates a pictorial view of the screening area according to the present invention, which is the functional/wear section of the panel and is replaceable. It shows a screening area made of polyurethane/rubber/steel. FIG. 3 also shows a sectional view along the line A-A.

Figure 4A:
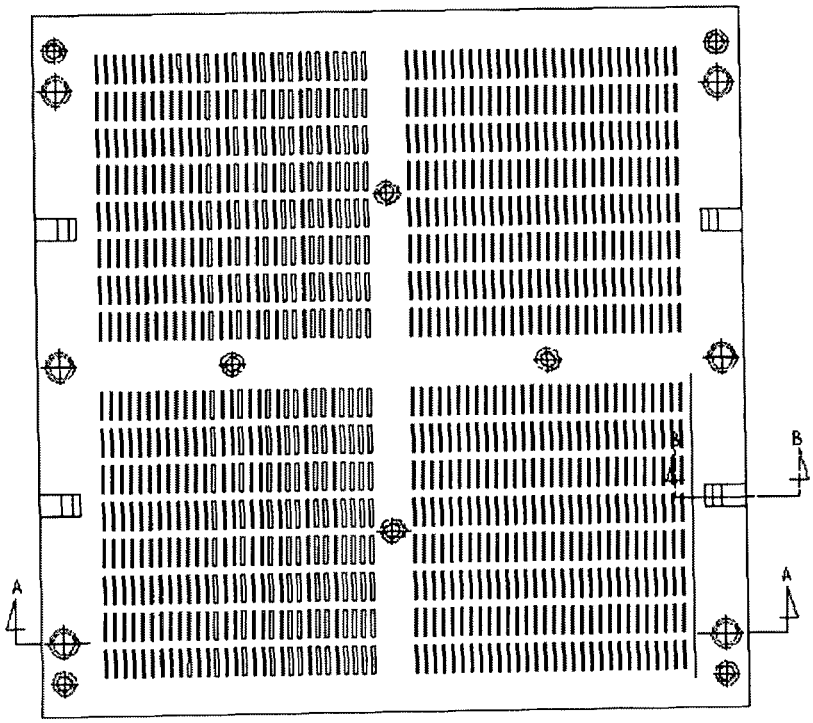
FIG. 4(*a*) illustrates a pictorial view of the screening area according to a preferred embodiment of the present invention.
Figure 4B:
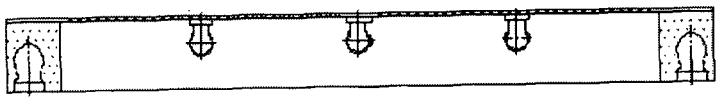

The accompanying FIG. 4(*a*) shows the screening area shown in FIG. 3 together with the frame, the frame being the reinforcing section and is non-replaceable.

The accompanying FIG. 4(*b*) shows a sectional view of the panel shown in FIG. 4(*a*) along the line A-A.

Figure 5:
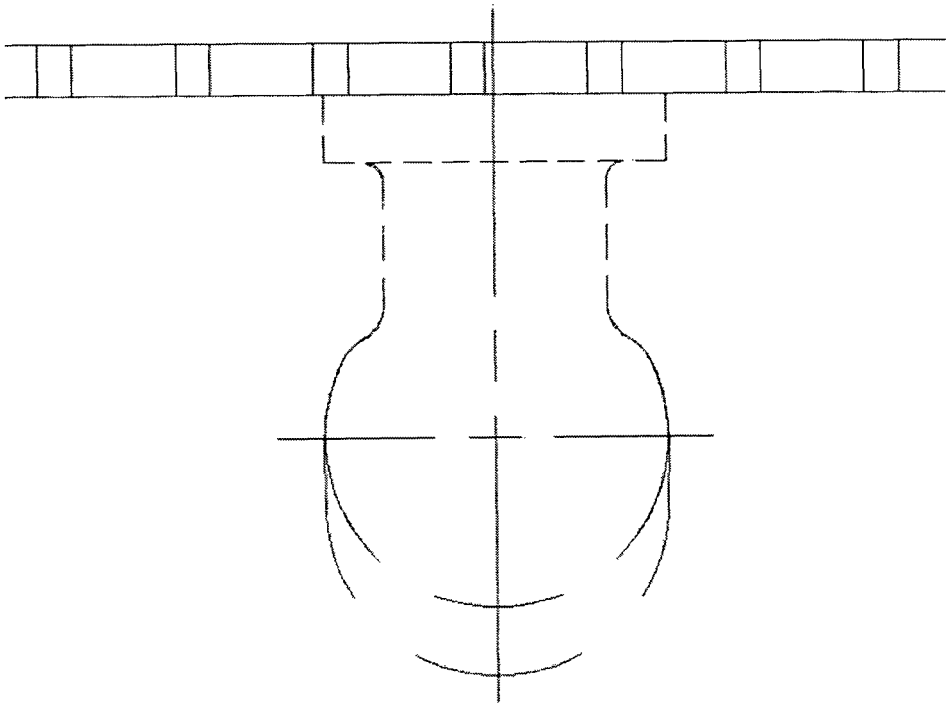
FIG. 5 illustrates how the reinforcing section and the wearing/functional section are fitted according to a preferred embodiment of the present invention.

The accompanying FIG. 5 illustrates the technology by which the screen panel with replaceable wear/functional section according to the present invention, is fixed to the frame of the machine. The fixing may be done by the button type snug fitting applying the fixing means, as protected by Indian Patent No. 231,453 of the applicant. The replaceable functional section may be fitted to the non-replaceable reinforcing section of the screen panel, according to the present invention, applying the same technology. For that purpose, button type male portion has to be provided on the top functional part, while the corresponding female part has to be in the reinforcement zone. Other type of fixing arrangements are also embraced by the present invention, as explained hereinafter.

Figure 6A:
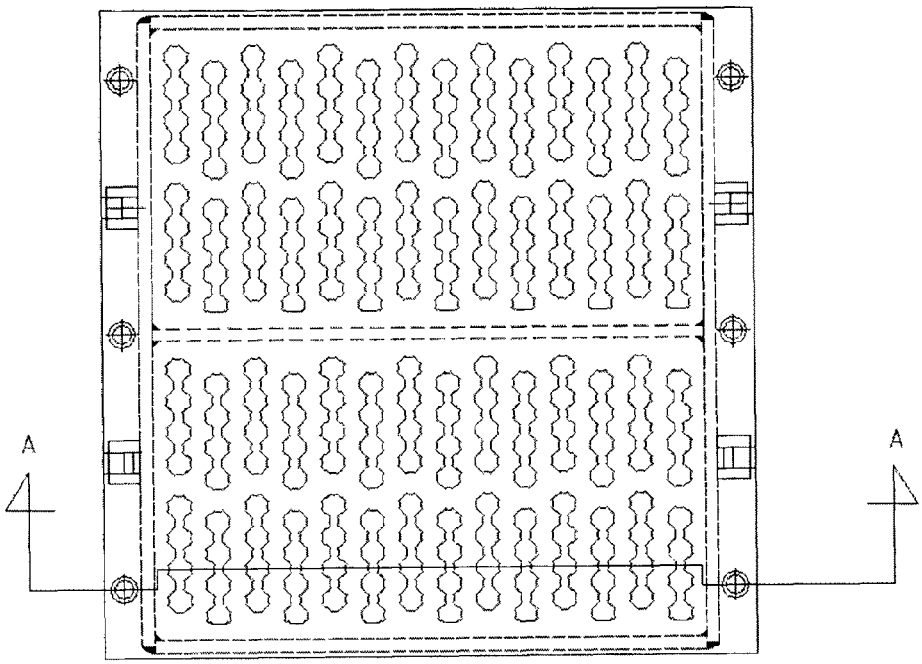
FIG. 6(*a*) illustrates a plan view of a conventional screen panel.
Figure 6B:
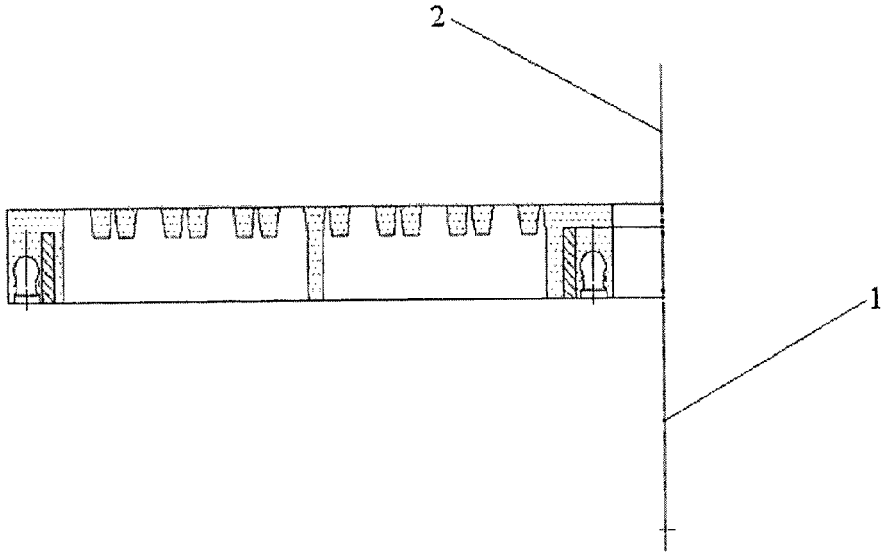
Figure 7A:
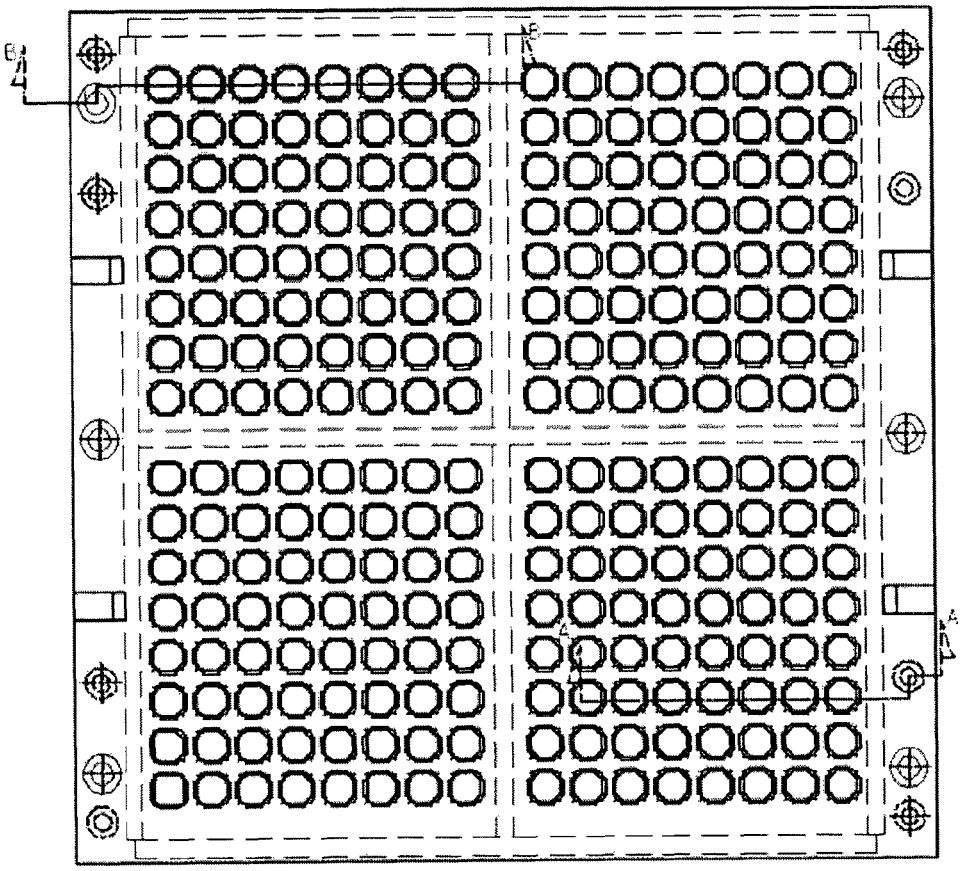
FIG. 7(*a*) illustrates a plan view of the screen panel according to a preferred embodiment of the invention.
Figure 7B:
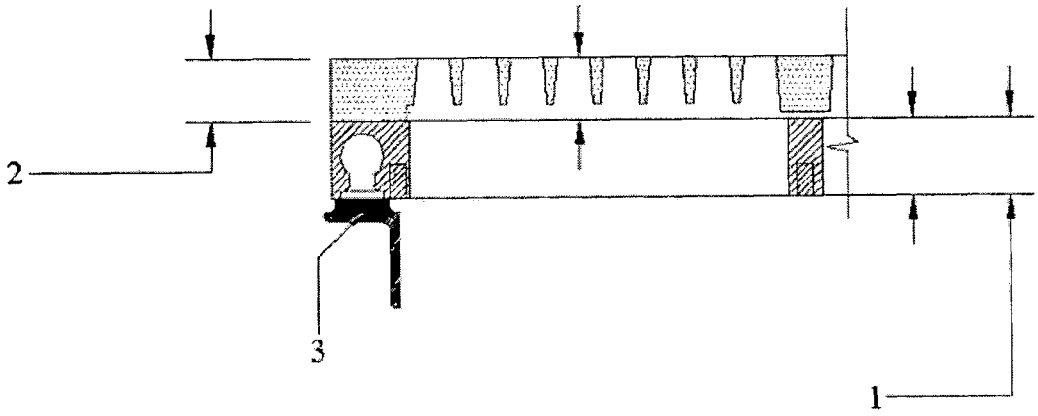
Figure 7C:
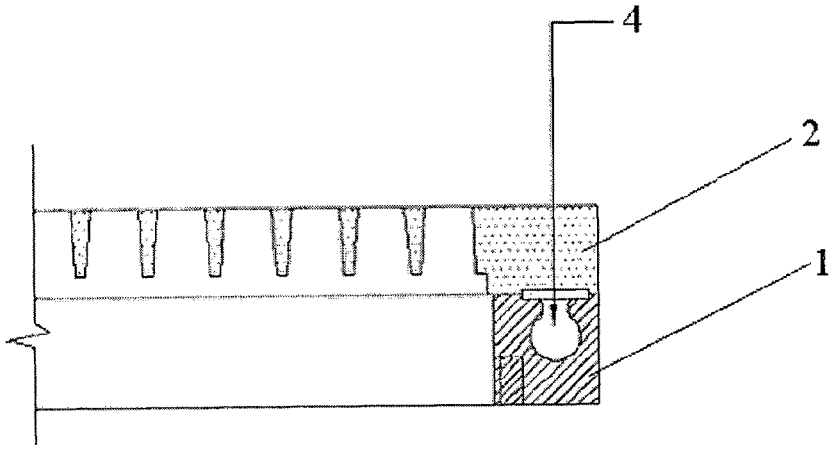

The accompanying FIG. 6(*a*) illustrates a plan view of a conventional screen panel having the wear zone integrated to the reinforcement zone and made in one piece. This is particularly clear from the sectional view in the accompanying FIG. 6(*b*) taken along the line A-A in FIG. 6(*a*). It shows the reinforcement zone (1) and the wear zone (2) integral to each other. On the contrary, the accompanying FIG. 7(*a*) illustrates a plan view of the screen panel according to the present invention, where the top wear zone (2) and the bottom reinforcement zone (1) constitute separate parts. This is particularly clear from the sectional view in the accompanying FIG. 7(*b*) taken along the line B-B in FIG. 7(*a*). It clearly shows that the wear zone (2) and the reinforcement zone (1) are separated. It also illustrates that by snug type fixing as described in the preceding paragraph, the reinforcement section (1) is fixed onto the frame/angle (3). The accompanying FIG. 7(*c*) illustrates a sectional view along the line A-A in FIG. 7(*a*). It illustrates how the two separated portions, namely the top and replaceable wear zone (2) is fixed to the bottom reinforcement zone (1) by snug type fixing arrangement (4), as detailed in the last four lines of the preceding paragraph. The top/wear part is provided with the snug type fixing (4), that fits into the cavity in the bottom/reinforcement part. Preferably, the wear zone has a thickness of 18 mm and the reinforcement zone has a thickness of 22 mm.

Now, instead of snug fitting type of arrangement, there may be pin and lug type fixing arrangement for fixing the two portions of the panel and for fitting the panel on to the machine frame. Alternatively, there may be bolt type of fixing arrangement.

Figure 8A:
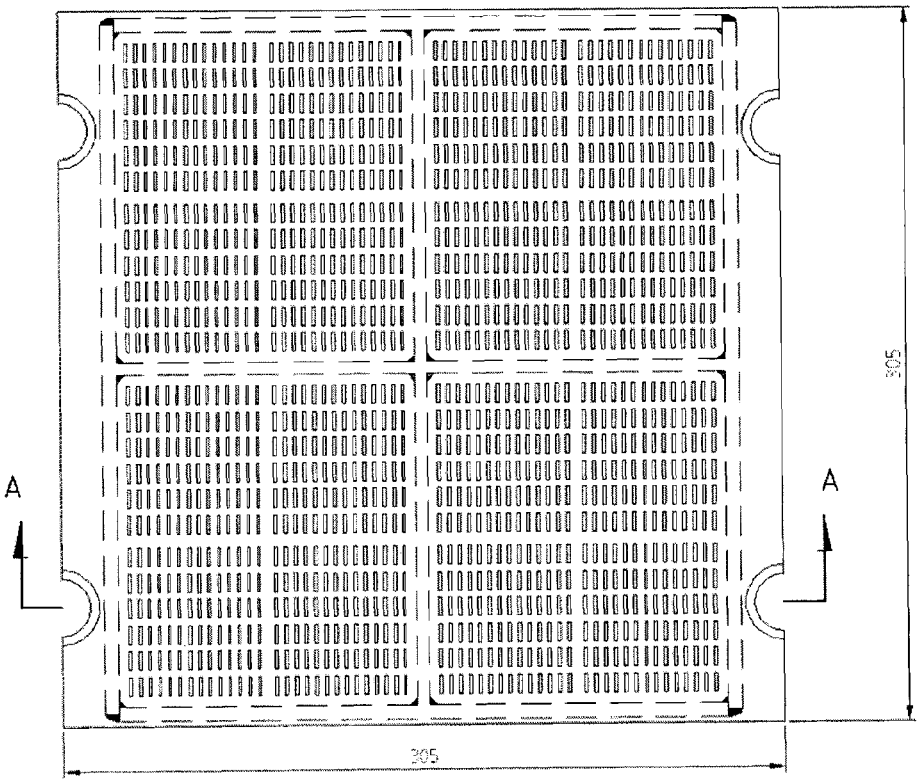
FIG. 8(*a*) illustrates a plan view of the screen panel according to another preferred embodiment of the present invention.
Figure 8B:
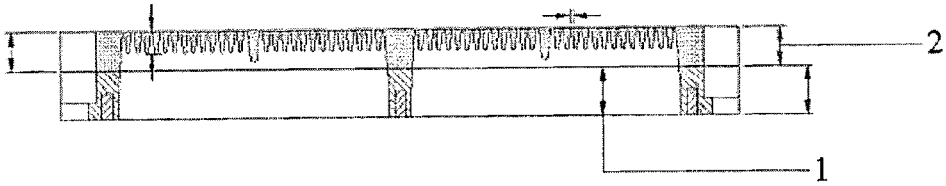

The accompanying FIG. 8(*a*) shows a plan view of a screen panel according to the present invention, having a replaceable top/wear part and a fixed, bottom/reinforcement part where the two parts are fixed by pin and separate lug arrangement. This would be particularly clear from the sectional view in the accompanying FIG. 8(*b*), taken along the line A-A in FIG. 8(*a*). It illustrates pin and lug fixing arrangement for fixing the top/wear zone (2) to the bottom/reinforcement zone (1). Preferably, the thickness of the wear zone is 10 mm and the thickness of the reinforcement zone is 30 mm and more preferably 22 mm.

Figure 9:
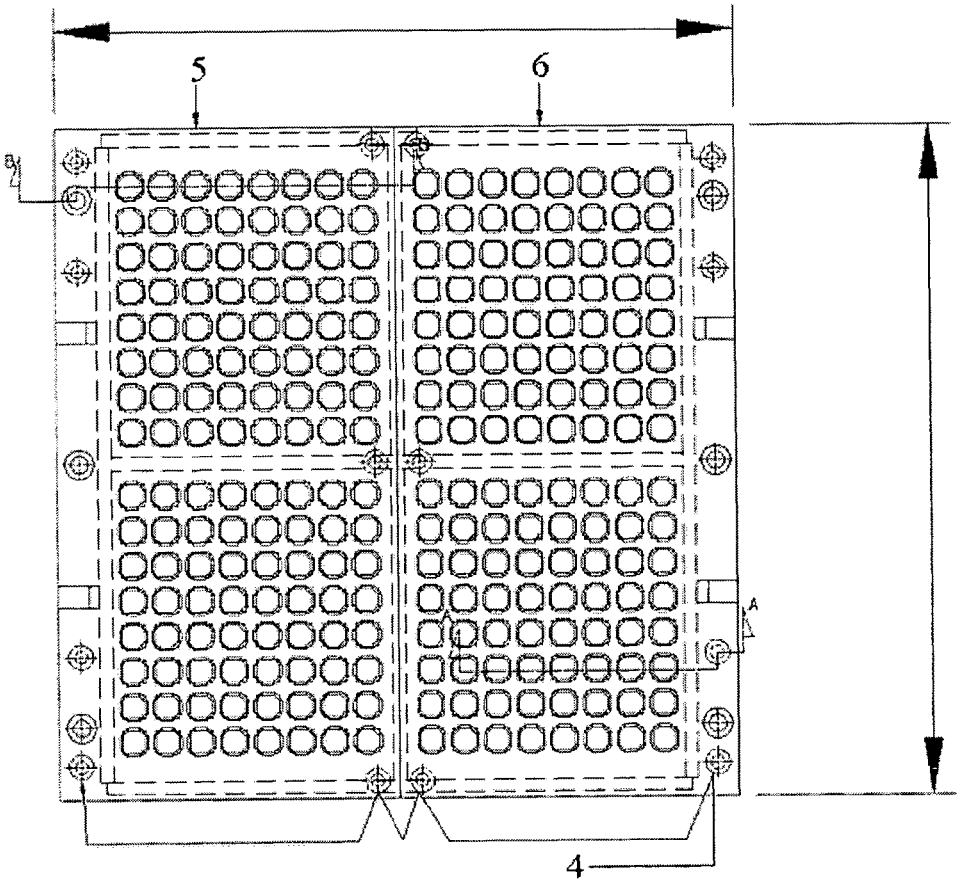
FIG. 9 illustrates a plan view of the screen panel according to a further preferred embodiment of the present invention.

The accompanying FIG. 9 illustrates a further preferred embodiment where the top/replaceable wear zone is divided into a top left part (5) and a top right part (6). Thus, the screen panel comprises three portions, top left part, top right part and the bottom reinforcement part. The top part of course, may be broken into three or more parts as well. So, in this way the screen panel according to the present invention may be divided into several modular parts each of which can be replaced from top, for convenient, smooth and perfect screening operation, which is economic as well. Although the fitting arrangement between the top portion and the bottom portion has been shown in the accompanying FIG. 9, as snug fitting type as discussed hereinabove, it should be understood that all possible fixing arrangements are possible.

In all the various preferred embodiments of the present invention, as described hereinbefore, the apertures of the removable screening area preferably has flaring design, for prevention of clogging of materials during screening operation.

The method of manufacturing a screen panel according to the present invention includes designing a wear section having a screening surface made up of materials such as herein described and a reinforcement section such as herein described and forming the wear section on said reinforcing section. The method further includes making the wear zone and the reinforcement zone as separate units such that, the wear section is replaceable from time to time, for ensuring smooth functioning of screening operation.

In a nutshell, the non-limiting advantages of the screen panel according to the present invention may be summarized as below:

1. The requirement for replacing the whole panel is done away with, thereby reducing the cost of operation and manufacturing of screen panels.
2. The screen panels are made light weight by making the top portion replaceable either in totality or in part.
3. The flaring design of the screening apertures, ensure prevention of clogging during screening operation.
4. Easy fitting of the panel to the machine frame and easy fitting between the top and bottom portion are ensured.
5. Flexibility and higher longevity are ensured.

The present invention has been described with reference to some drawings and preferred embodiments, purely for the sake of understanding and not by way of any limitation and the present invention includes all legitimate developments within the scope of what has been described hereinbefore and claimed in the appended claims.

I claim:

1. A screen panel for mining and quarrying industries adapted to be mounted on a screen deck including a wear section and a reinforcement section, said wear section comprising a screening surface made up of materials formed on said reinforcement section such as herein described, said wear section being the top portion of said panel and said reinforcement section being the bottom portion of said panel, said wear section and said reinforcement section being separate units and said wear section being adapted to be replaceable from time to time, said wear section having a button type snug fitting coupling the wear section to the reinforcement section, said reinforcement section having a fitting for coupling the reinforcement section to a machine frame of a screen deck, wherein said button type snug fitting protrudes from a surface facing the reinforcement section, and wherein the reinforcement section has a aperture defined in a surface facing the wear section and receiving the button type snug fitting for removably coupling said wear section to said reinforcement section without separating said reinforcement section from said machine frame.

2. The screen panel as claimed in claim 1, wherein said screening surface comprises abrasion resistant apertures having a flaring design, wherein a cross-sectional area of the aperture is smaller at the upper surface of the wear section than at the lower surface of the wear section.

3. The screen panel as claimed in claim 1, wherein said wear section is separated into two or more units.

4. The screen panel as claimed in claim 1, wherein said wear section and said reinforcing section are adapted to be attached to the machine frame by button type snug fitting.

5. The screen panel as claimed in claim 4, wherein said wear section is made up of at least one of polyurethane, rubber, and steel, wherein said reinforcement section is a frame made by hot vulcanizing or casting with rubber or polyurethane.

6. The screen panel as claimed in claim 1, wherein said screening surface is made of any one of or a combination of mild steel, stainless steel, rubber and/or polyurethane with or without steel reinforcing.

7. The screen panel as claimed in claim 6, wherein said screen panel comprises a vulcanized material, rubber, or polyurethane, wherein said screen panel has embedded within it steel reinforcing bars, at the outer edges of said screen panel and extended across an inner area of said panel, thereby providing support to said screening surface.

8. The screen panel as recited in claim 1, wherein a greater number of button type snug fittings couple said wear section to said reinforcement section than couple said reinforcement section to said machine frame.

9. The screen panel as recited in claim 1, wherein said reinforcement section has an upper and an opposed lower surface, wherein said upper surface has an aperture for receiving said button type snug fitting of said wear section, wherein said lower surface has an aperture for receiving a button type snug fitting of said machine frame.

10. The screen panel as recited in claim 1, wherein said button type snug fitting is a disposed on a peripheral portion of the wear section.

11. The screen panel as recited in claim 10, wherein said button type snug fitting is a first button type snug fitting, and further including a second button type snug fitting disposed on a central portion of the wear section.

12. The screen panel as recited in claim 11, wherein the second button type snug fitting is disposed between the first button type snug fitting and a center of the screen panel.

13. A screening deck for mining and quarrying industries, having mounted thereon a plurality of screening panels, each said panel including a wear section and a reinforcement section, said wear section comprising a screening surface made up of materials such as herein described formed on said reinforcement section, said wear section being the top portion of said panel and said reinforcement section being the bottom portion of said panel, said wear section and said reinforcement section being separate units and said wear section being adapted to be replaceable from time to time, said wear section having a button type snug fitting coupling the wear section to said reinforcement section, said reinforcement section having an aperture coupling said reinforcement section to a button type snug fitting fixed to a machine frame of said screening deck, wherein said button type snug fitting protrudes from a surface facing the reinforcement section, and wherein the reinforcement section has a aperture defined in a surface facing the wear section and receiving the button type snug fitting for removably coupling said wear section to said reinforcement section without separating said reinforcement section from said machine frame.

14. A screen panel for mining and quarrying industries adapted to be mounted on a screen deck including a wear section and a reinforcement section, said wear section comprising a screening surface made up of materials formed on said reinforcement section such as herein described, said wear section being the top portion of said panel and said reinforcement section being the bottom portion of said panel, said wear section and said reinforcement section being separate units and said wear section being adapted to be replaceable from time to time, said wear section having a button type snug fitting coupling the wear section to the reinforcement section, said reinforcement section having a fitting for coupling the reinforcement section to a machine frame of a screen deck, wherein said reinforcement section has an upper and an opposed lower surface, wherein said upper surface has an aperture for receiving said button type snug fitting of said wear section, wherein said lower surface has an aperture for receiving a button type snug fitting of said machine frame.

15. The screen panel as recited in claim 14, wherein a greater number of button type snug fittings couple said wear section to said reinforcement section than couple said reinforcement section to said machine frame.

16. The screening deck as recited in claim 15, wherein a greater number of button type snug fittings couple said wear section to said reinforcement section than couple said reinforcement section to said machine frame.

17. A screening deck for mining and quarrying industries, having mounted thereon a plurality of screening panels, each said panel including a wear section and a reinforcement section, said wear section comprising a screening surface made up of materials formed on said reinforcement section such as herein described, said wear section being the top portion of said panel and said reinforcement section being the bottom portion of said panel, said wear section and said reinforcement section being separate units and said wear section being adapted to be replaceable from time to time, said wear section having a button type snug fitting coupling the wear section to said reinforcement section, said reinforcement section having an aperture coupling said reinforcement section to a button type snug fitting fixed to a machine frame of said screening deck, wherein said reinforcement section has an upper and an opposed lower surface, wherein said upper surface has an aperture for receiving said button type snug fitting of said wear section, wherein said lower surface has an aperture for receiving a button type snug fitting of said machine frame.

* * * * *